United States Patent [19]

Berry

[11] Patent Number: 4,775,151

[45] Date of Patent: Oct. 4, 1988

[54] APPARATUS FOR CONTROLLING AND SIMULATING THE GAME OF FOOTBALL

[76] Inventor: Gregory A. Berry, 808 Monroe St., Herndon, Va. 22070

[21] Appl. No.: 64,064

[22] Filed: Jun. 19, 1987

[51] Int. Cl.[4] ..... A63B 67/00

[52] U.S. Cl. ..... 273/55 R; 273/55 B; 273/1 ES

[58] Field of Search ..... 273/94, 55 R, 55 B, 273/1 G, 1 GC, 1 GE, 1 ES; 116/222; 340/323 R

[56] References Cited

U.S. PATENT DOCUMENTS

| | | | |
|---|---|---|---|
| 3,700,238 | 10/1972 | Mathis | 273/55 R |
| 4,215,856 | 8/1980 | Schmall et al. | 273/55 R |
| 4,534,557 | 8/1985 | Bigelow et al. | 273/55 A |

FOREIGN PATENT DOCUMENTS

| | | | |
|---|---|---|---|
| 2166056 | 4/1986 | United Kingdom | 273/1 ES |

*Primary Examiner*—Leo P. Picard
*Assistant Examiner*—Jessica J. Harrison
*Attorney, Agent, or Firm*—Bill B. Berryhill

[57] ABSTRACT

Apparatus for controlling and simulating certain aspects of the game of football which includes: a housing for portably housing components of the apparatus; a micro-processor for processing signals representative of designated time elements of a football game; a power device for supplying operating power to the micro-processor; and a switch connected to the micro-processor for initiating specific functions thereof in response to movement of a football placed on the housing or removed thereform.

12 Claims, 4 Drawing Sheets

APPARATUS FOR CONTROLLING AND SIMULATING THE GAME OF FOOTBALL

BACKGROUND OF THE INVENTION

1. Field of the Invention

The present invention pertains to the game of football. Specifically, the present invention pertains to apparatus suitable for controlling and simulating certain aspects of the game of football. More specifically, the present invention pertains to apparatus for measuring and indicating designated time elements of a football game, such as, huddle time, time out and game time and other key game parameters such as number of timeouts, score, down, yards to go for first down, passes completed, quarter, etc.

2. Brief Description of the Prior Art

The game of football, while not complicated, requires keeping of considerable game statistics and time information. In high school, college and professional football games this is usually accomplished by referees, judges, scorekeepers, yard marker handlers, etc. This may be fine for scheduled games, but may not be practical for practice games, scrimmages or sandlot play.

Various devices have been developed over the years for aiding in the control and scoring of various games of sport. For example, U.S. Pat. No. 2,190,543 discloses a mechanized score board and timing device for basketball. In U.S. Pat. No. 2,993,288 a pocket sized scoring indicator is described for the game of baseball. U.S. Pat. No. 3,006,315 discloses a pocket sized scoring indicator whereby the score of a football game either in a stadium, over television, or radio, may be continuously indicated. While these devices aid in keeping track of the score in a particular game, they are not suitable for controlling various time criteria of a football game.

Other devices have been developed, particularly for the game of football, to aid in the training of quarterbacks, kickers, etc. For example, U.S. Pat. No. 3,399,892 discloses a mechanical training device to be used by quarterbacks in practicing reception of the ball at the start of play. This device simply stimulates the delivery of the ball from the center to the quarterback of a football team. In U.S. Pat. No. 3,700,238, a machine is disclosed for simulating the snap of the ball from the center to the quarterback. In addition, one or more timers and alarms are provided which time and signal the lapse of time allotted in which the quarterback must execute a play. U.S. Pat. No. 4,261,564 discloses apparatus for practicing punting, passing, or kicking of the football. This device is primarily for use in measuring azimuth angle, equivalent distance and angle of elevation of a ball that is punted, passed or kicked. While these devices aid in the practice of certain aspects of a football game, they are very limited in function.

Thus, there are devices in the prior art for scoring, timing and simulating certain aspects of a football game. However, these devices are relatively limited in purpose and function. There appears to be few, if any, apparatus suitable for timing, scoring and other controlling criteria of a football game.

SUMMARY OF THE PRESENT INVENTION

The present invention provides apparatus for controlling and simulating certain aspects of the game of football. It includes a housing for portable housing components of the apparatus and for placement at any point on a football field to generally represent the ball position on the line of scrimmage. A micro-processor unit is carried by the housing for processing signals representative of designated time elements of a football game. A power device, i.e., a battery, is carried by the housing and connected to the micro-processor unit for supplying operating power thereto. A pressure switch is carried by the housing and connected to the micro-processor unit for initiating specific functions thereof. The switch is adapted to receive a football thereon and is movable from a first position to a second position to a response to a football being removed therefrom, and from the second position to the first position in response to the football being placed thereon. In addition, one or more numeric index or register devices may be carried by the housing for indicating various criteria of the game, e.g. timeouts, score, down, yards to go for a first down, pass completed, quarter, etc.

Thus, the present invention relates to the playing of football on a field and keeping track of various time elements and other statistical data of the game. With the apparatus of the present invention the game may be controlled and played by the players only without the need of additional personnel such as referees, time keepers, score keepers, etc. Even though these additional individuals are not required, the apparatus of the present invention closely simulates the function of such individuals to provide the real excitement and challenge of the game.

The apparatus of the present invention provides a new and improved method of controlling events of a football game which will operate manually, automatically, and/or remotely if desired. The portable apparatus is positioned on the field at the line of scrimmage and contains a micro-processor unit which includes required time clock components and associated controls, alarms, adjustments and switches to simulate and record actual game conditions and statistics. The time functions, alarms and displays operate individually, jointly and/or simultaneously in order to provide interaction with the football, manual function buttons and/or remote signals to achieve the same format, order and/or procedures on a football field which would be expected if a referee and other personnel were present.

The apparatus of the present invention provides control, scoring and condition simulation of a football game not heretofore provided in a single compactly packaged device. Many other objects and advantages will be apparent from reading the description which follows in conjunction with the accompanying drawings.

DESCRIPTION OF A PREFERRED EMBODIMENT OF THE INVENTION

Figure 1:
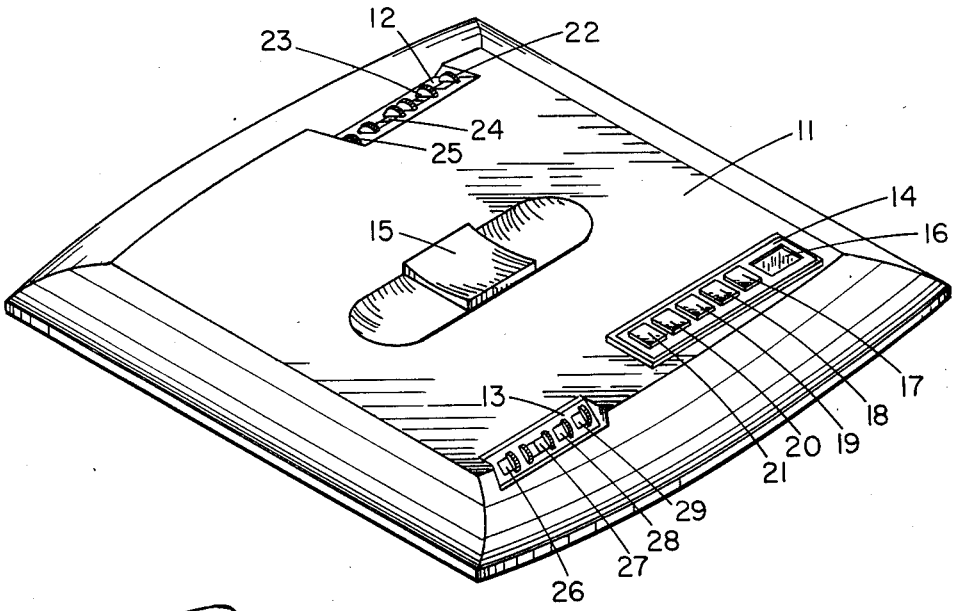
FIG. 1 is a perspective view of apparatus for controlling and simulating certain aspects of the game of football, according to a preferred embodiment of the invention.

Referring first to FIG. 1, there is shown apparatus 10 for controlling and simulating certain aspects of the game of football. The apparatus 10 is especially adapted for operation on the field by team players to control the game within the framework of time and to record the statistics thereof. The apparatus 10 will, of course, be utilized in conjunction with a football, illustrated at 70. The entire apparatus may be carried in a housing, the upper portion 11 of which is free formed in the shape of a modified oval the ends of which are cut off. Although the dimensions may be varied, the housing portion 11 is typically eight inches long, eight inches wide and one inch high at the center. The housing portion 11 gradually slopes to the outside perimeter and at the perimeter has a thickness of approximately one-eighth of an inch.

Figure 2:
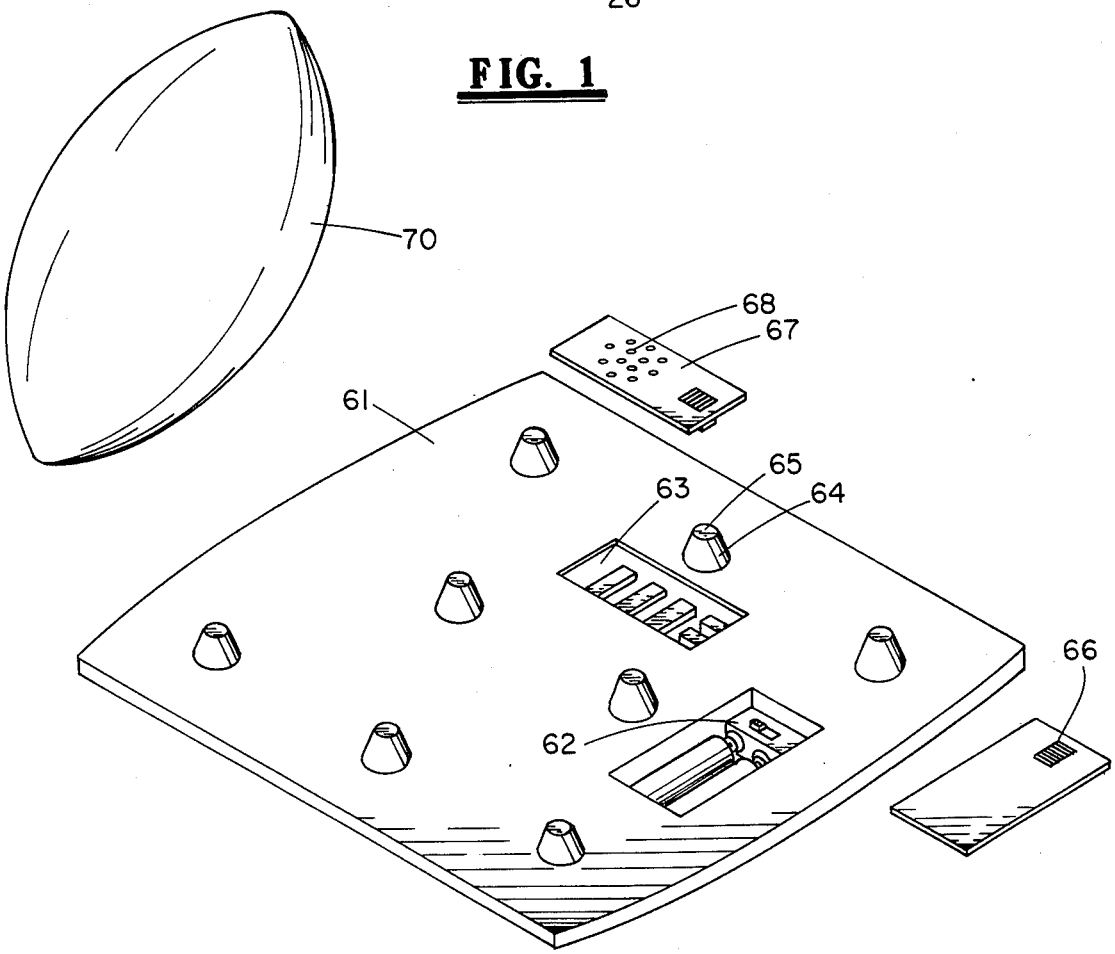
FIG. 2 is an underside perspective view of the apparatus of FIG. 1, certain portions of which have been removed for a better understanding thereof.

The lower portion 61 of the housing, the bottom side which is illustrated in FIG. 2, is essentially flat and shaped to match the perimeter of the upper housing portion 11, but has a plurality of legs 64 projecting therefrom. The legs 64 provide stability in grass and help absorb shock. A battery compartment 62 and a micro-processor compartment 63 is provided therein. A cover 66 is provided for the battery compartment 62 and a cover 67 is provided for the adjustment compartment 63. The cover 67 may be perforated as at 68 to provide a vent therefor. Holes 65 may be provided through the legs 64 through which screws (not shown) may be passed for engagement with threaded holes (not shown) provided underneath upper housing portion 11 by which the upper and lower housing portions 11 and 61 are held together to carry other components of the apparatus. The upper housing portion 11 may be molded or formed with ribs underneath (not shown) designed to contact the upper side of the lower housing portion 61 to give strength to the housing 11, 61 so that it maintains its structural integrity even if stepped on by a player.

Four rectangular holes are cut in the top housing 11 to provide mounting of numeric index assemblies or registers 12 and 13, display and function assembly 14 and a weight switch 15, components of the present invention which will be described in much greater detail hereafter. For the present it is sufficient to understand that the numeric index assembly 12 contains indexes for indicating home team timeouts 22 and score 23 and visiting team timeouts 25 and score 24. The numeric index assembly 13 indicates the down 26, yards to go for a first down 27, passes completed 28 and quarter 29.

Figure 7:
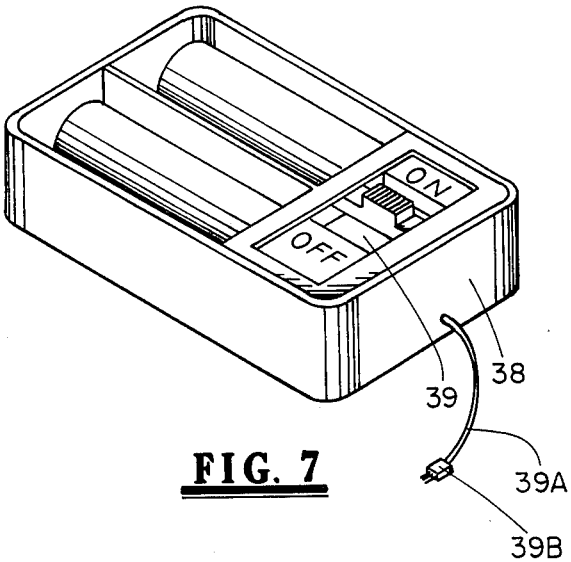
FIG. 7 is a bottom perspective view of a battery unit suitable for use as the power supply of the apparatus of the present invention.
Figure 11:
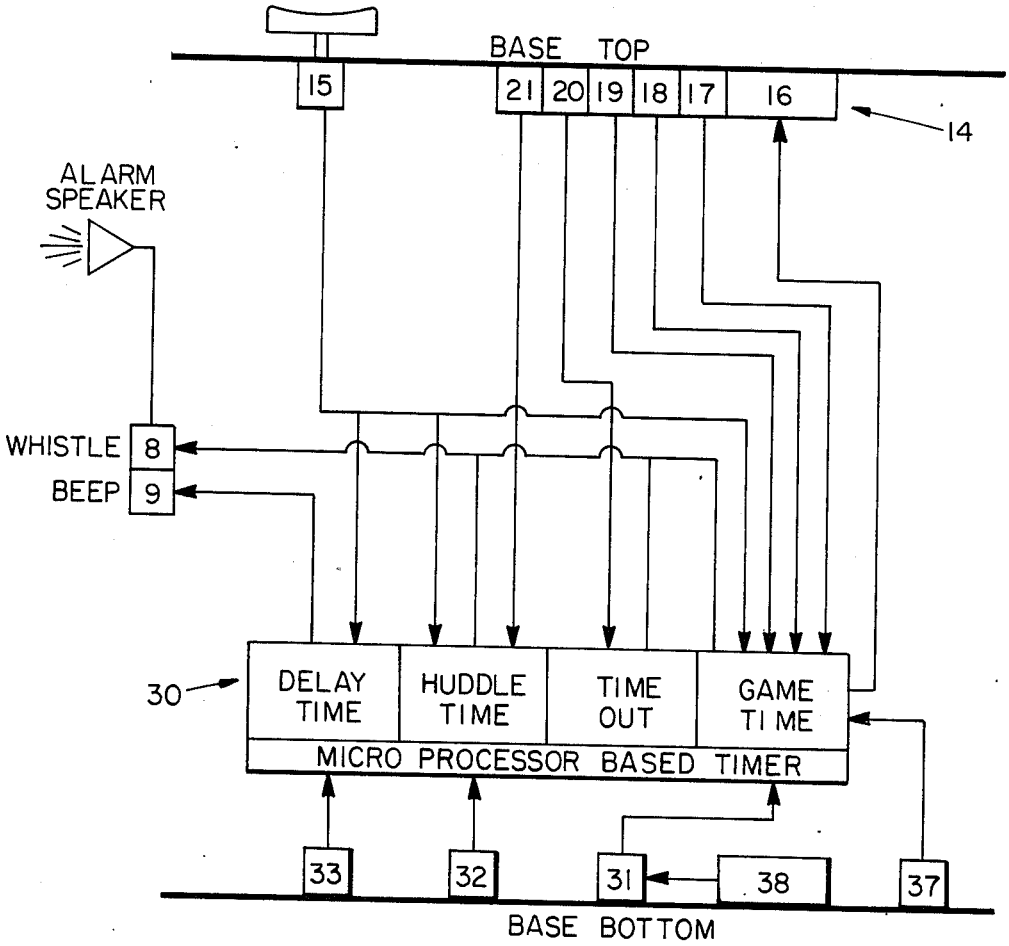
FIG. 11 is an electronic block diagram showing the interconnection of electrical components of the apparatus of the present invention.

The function and display assembly 14 has an LCD display 16 for indicating time remaining in a particular quarter, a start/stop button 17 for the game quarter clock, a time up button 18 for moving the game time forward, a time down button 19 for moving the game time backward, a timeout button 20 and a huddle button 21. The display and function assembly 14 is illustrated in greater detail in FIGS. 3 and 4. The assembly 14, as also indicated in the schematic of FIG. 11, is associated with an intergrated time clock based micro-processor unit 30 within which are various electronic components for time clocks, alarms, speakers, number generators, displays and associated networking to provide the actions and sequences necessary. Power is supplied to the micro-processor unit 30 through a battery unit 38 with an on/off power switch 39. (FIGS. 7 and 11.) As already indicated, the display and function assembly 14 has five function buttons 17, 18, 19, 20 and 21 as well as an LCD display 16. These function buttons control the manual operation of the micro-processor clocks. Manual operations associated with the buttons 17, 18, 19, 20 and 21 are: starting and stopping the game quarter clock, advancing the game quarter time clock up at an accelerated rate, declining the game quarter clock down at an accelerated rate, starting the time out clock, and starting the huddle clock, respectively.

Each time the stop/start button 17 is pushed the game quarter clock starts or stops. Each time the stop/start button 17 is pushed there is an audible whistle alarm. The duration of this alarm is two seconds. Advancing the game quarter clock manually is accomplished by depressing the time up button 18 and keeping it depressed until the required time is shown on the LCD display 16. Declining the game quarter clock manually is accomplished the same way by depressing the time down button 18.

Depressing the time out button 20 causes the game quarter clock time to stop. An audible whistle occurs at this time. The time out clock runs down at the time of typically one minute when the alarm whistle sounds again.

The huddle clock is started manually by pressing the huddle button 21. At the time the huddle button 21 is depressed, the huddle time clock runs down a specified time when an alarm whistle occurs. A game quarter clock time is not displayed during the huddle clock time but will resume the game quarter time when a timed huddle is not in progress. If the huddle time expires prior to the snap of the football, the game quarter clock will stop and an audible whistle alarm will be heard. If the football is successfully snapped, the huddle time clock will stop and no alarm will be heard. The game quarter clock will automatically start if it is not running. The LCD display 16 will display the game quarter time at all times that the huddle clock is not running. The huddle clock is displayed only when the huddle clock is running.

The manual function control buttons 17, 18, 19, 20 and 21 described are used to perform a variety of tasks on the field much the same as a referee would be expected to do with a pocket stop watch. The automatic functions allow the players, on the field to use the device without the need of a referee.

Figure 4:
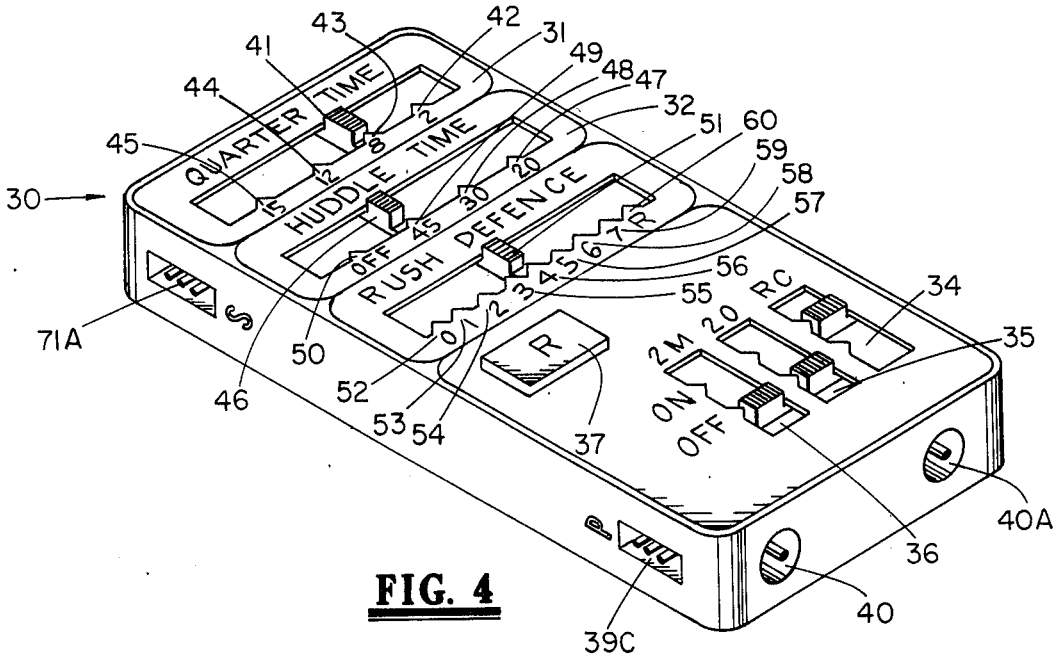
FIG. 4 is a bottom perspective view of the intergrated micro-processor unit of FIG. 3., showing associated adjustment devices, switches, ports and receptacles.

The adjustment settings and other game function switches of the micro-processor unit 30 are best understood by referring to FIG. 4. These adjustment setting and other game function switches are to allow the apparatus to be adjusted for variable time requirements and rules. For example, the National Football League, Canadian Football League and National Collegiate Athletic Association have different requirements that can be accommodated with the apparatus of the present invention.

The micro-processor adjustments and settings can best be understood with reference to FIG. 4, a view of the underside of the micro-processor unit 30. The game quarter time portion of the process is represented at 31, huddle time portion at 32, rush defense time portion at 33, remote control setting at 34, four quarter setting at 35, two minute warning setting at 36 and game reset button at 37. All of the processor adjustments and settings are automatic in the sense that once set the micro-processor 30 will integrate the action of these clocks, continuously making all necessary resets of the clocks and alarms to allow for the playing of the complete game.

The game quarter clock portion 31 has four adjustment indices 42, 43, 44 and 45. 45 represents a fifteen minute adjustment, 44 a twelve minute adjustment, 43 an eight minute adjustment and 42 a two minute adjustment. These fixed adjustment points are set through the use of a sliding bar, four position switch 41. The clock portion of the micro-processor associated with the game time, once started, would count down in one second increments from its setting to expiration, unless otherwise manually, automatically or remotely stopped. Each and every time the associated clock portion stopped, an audible whistle alarm will occur and each time that the clock is manually and/or remotely started a whistle alarm will occur. No whistle alarm will occur when the clock of the game time portion 31 is started automatically.

The game huddle time portion 32 has adjustment points 47, 48, 49 and 50. These are fixed time adjustments at 47 for twenty seconds, at 48 for thirty seconds, at 49 for forty-five seconds and off at 50. These fixed adjustment points are set through the use of a sliding bar, four position switch 46. After the clock of this portion 32 of the micro-processor unit has been manually started by the huddle button 21 the huddle clock will be automatically reset to the corresponding reposition time. An audible whistle will be sounded and time will begin to run down in one second increments until the huddle time is expired. However, the huddle clock count can be automatically cancelled by the action of the football 70 being removed from the weight switch assembly 15 in which case the game quarter clock portion 31, if not running, will start with no alarm sounding.

The game rush defense portion 33 has several adjustment points 52–60. The off setting is represented at 52, one second adjustment at 53, two second adjustment at 54, three second adjustment at 55, four second adjustment at 56, five second adjustment at 57, six second adjustment at 58, seven second adjustment at 59 and random adjustment at 60. These fixed adjustment points are set through the use of a sliding bar, nine position switch 51. Unless the switch 51 is in the off position 52, the rush defense clock portion of the micro-processor is reset at the beginning of the game and every time the football 70 is set on the weight switch assembly 15. When the football 70 is removed from the weight switch assembly 15, the rush defense clock automatically runs down at one second increments to its expiration, with the exception of the random setting 60. The random setting 60 will, at random and of its own design, choose any count from one to seven seconds and then count in one second increments to expiration. At the expiration of the set rush defense count an audible beep alarm will occur. It is important to note that the rush defense portion 33 of the micro-processor unit is different from that of the other portions. The rush defense portions' clock is not a part of standard type game play but is a very challenging part of the device as far as game play on the field by a limited number of players is concerned. The rush defense portion 33 can substitute for a non-existent offensive and/or defensive line through the substitution of a time count. The random setting 60 can allow the defense to penetrate this non-existent offensive line at an unknown moment. This allows for an unpredictable rush of the quarterback by imaginary defensive line defenders.

The micro-processor unit 30 may be provided with a remote control setting 34 which, when activated, allows stopping and/or starting of the game quarter clock portion 31 from a remote distance of, e.g., 200 feet. This is done in the same manner that presently allows a variety of other devices to respond to an audible signal such as a whistle. These devices are presently commercially available and are used, for example, in locating key holders from a remote distance. The remote control setting 34 will respond to a sound generated from a standard referees mouth whistle. When this remote setting 34 is on, the game clock portion 31 of the micro-processor unit, will, each time it receives the whistle sound signal, alternately stop and/or start the game quarter clock. In addition, when the remote setting 34 is on, the whistle sound signal receiver 40 will not respond to the whistle sounds generated by the micro-processor unit 30. This is achieved by having the micro-processor unit 30 automatically turn off the sound signal receiver 40 every time the processor unit alarms and then to automatically turn the sound signal receiver 40 back on after each of the processor's alarm functions are complete. It should be noted that when the remote setting 34 is on, all the other functions of the micro-processor unit 30 will still operate manually and/or automatically.

The four quarter setting 35 of the micro-processor unit, when turned on and in use, allows for automatic resetting of the established game parameters set on the game quarter clock portion 31, the huddle clock portion 32, rush defense portion 33 and the remote setting 34 three consecutive times after the completion of the first quarter, thus allowing for the playing of a complete football game of four quarters. When the four quarter setting 35 is off, the processor portions 31, 32, 33 and setting 34 will not automatically reset. However, they can be reset by using the provided game reset button 37.

When in the "on" position, the two minute warning setting 36 allows automatic stopping of the game quarter clock portion 31 at the two minute mark of the quarter. This two minute warning setting 36 is manually turned off and on to provide such warning at the beginning of and/or prior to the depletion of two minutes on the game quarter clock in the quarter that this warning is desired and/or required. The game reset button 37 allows the resetting of all previously or presently set game time parameters every time it is pushed.

Figure 3:
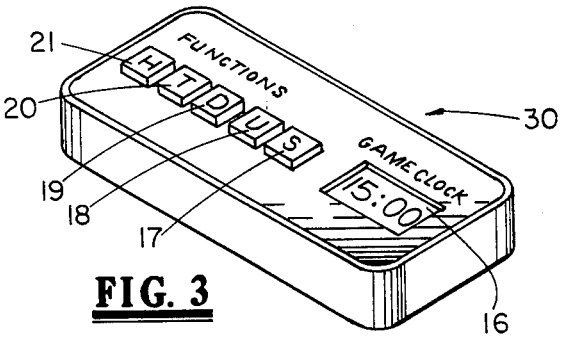
FIG. 3 is a top perspective view of an intergrated micro-processor unit which is one of the components of the preferred embodiment of the invention.
Figure 5:
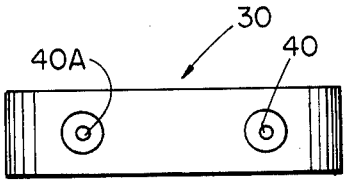
FIG. 5 is an end view of the micro-processor unit of FIGS. 3 and 4 showing port locations for speakers and remote signal receivers which may be utilized with the apparatus of the present invention.

Thus, the micro-processor unit 30 is the heart of the invention in its ability to achieve all of the time related functions thereof. The micro-processor unit 30 may be manufactured as a single integrated unit much in the same manner that presently commercially available sophisticated multifunction wrist watches are. The micro-processor unit 30 contains all the components, chips, switches, controls, alarms, receivers, number generators, displays, adjustments and accessories that are required to allow all the time related functions, alarms and displays to operate individually, jointly and/or simultaneously in order to provide automatic, manual or remote interaction with the football to achieve the format, sequence and/or procedures desired. The manner of manufacture of micro-processor unit 30 is presently state-of-the-art procedure using commercially available components and parts. When assembled the processor unit 30 is made as thin as practical. The unit 30 is assembled with the display and function assembly 14 thereof as shown in FIGS. 3 and 4. FIG. 5 shows an end view indicating locations of the sound signal receiver 40 and the alarm speaker port 40A. As assembled, the micro-processor unit 30 has ports, switches, buttons and displays on four of the six sides thereof. The complete unit is installed in the apparatus between the upper and lower housing portions 11 and 61 for access through the recess 63 (see FIG. 2).

Figure 6:
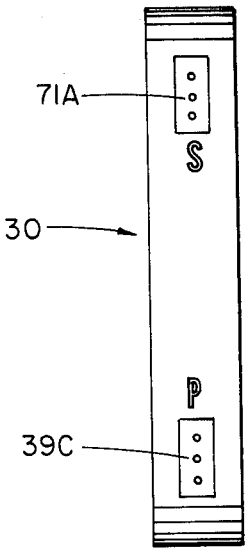
FIG. 6 is a side view of the micro-processor unit of FIGS. 3, 4 and 5 showing the location of electrical receptacles for connecting the micro-processor unit with switch means and power means of the apparatus of the present invention.

FIG. 7 illustrates a battery holder unit 38 and power on/off switch 39 along with wire leads 39A and associated male plug 39B which when installed provides power to the micro-processor. The plug 39B is plugged into the female power receptacle 39C illustrated on one side of the processor 30 as seen in FIG. 6. The self-contained battery holder 38 may be supplied with two size AA nine volt batteries. The on/off switch 39 is an ordinary two position switch commonly in use. The power unit 38 may be installed in the recess 62 provided on the bottom housing 61 (see FIG. 2).

Figure 9:
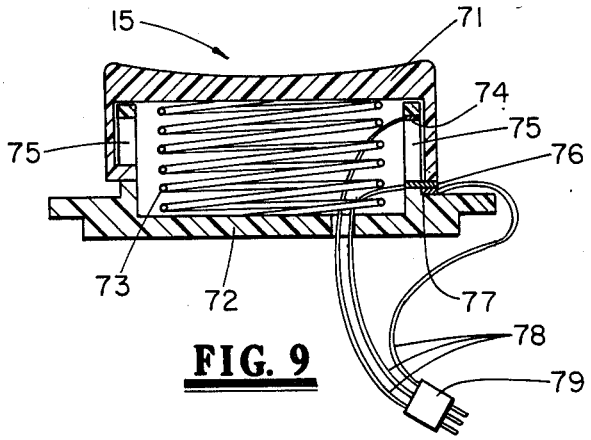
FIG. 9 is a cross-sectional side view of a switch unit which is one of the components of the apparatus of the present invention.
Figure 10:
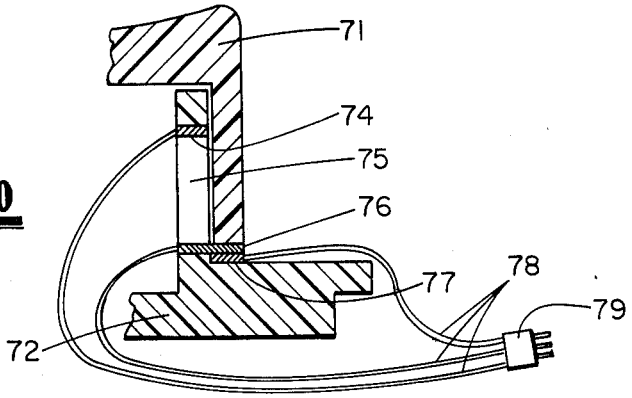
FIG. 10 is a detailed sectional side view of the switch unit of FIG. 9 better illustrating the contacts and operation thereof.

A very important component of the apparatus of the present invention is the weight switch assembly 15. The weight switch assembly 15 and its construction can best be seen in FIGS. 9 and 10. The assembly 15 includes a spring 73 sandwiched between upper and lower housing portions 71 and 72, respectively. The spring 73 biases the upper portion 71 away from the lower portion 72, thus, separating the contact points 74 and 77 of switch 76. Wire 78 connects the switch 76 to a male plug 79 which plugs into the female receptacle 71A of the micro-processor unit 30 (see FIG. 6). The void 75 is a combination guide and stop slot and is provided in each of the four sides of the switch assembly 15. In three of the four guide and stop slots the guide portion is an integral part of the one piece plastic upper housing portion 71. In the fourth guide position exists the actual electrical switch mechanism that also serves as a guide and stop slot. This is achieved by placing copper contact points at the stop locations 74 and 77 and having the guide made of copper. The wires are then soldered to these contacts 74, 76, 77 and the wire group 78 is attached to a male plug 79.

The upper housing portion 71 has a pronounced concave contoured shape matching that of the outside radius of a standard size football. The size of the top housing is approximately two inches by two inches by three-quarters of an inch high. The top surface of the housing is smooth. This allows a football placed thereon to be manually adjusted from a relative flat position to a more inclined position similar to standard snap positions which players are accustomed to, or to allow the housing to function as a kicking tee.

The mechanism of the weight switch 15 includes the two position electronic contact switch 76. The switch has a one-quarter inch stroke in moving from the lower contact 77 to the upper contact 74. The switch is biased toward an upward position by spring 73. However, with a football 70 resting on the upper housing portion 71, the bias of the spring is overcome so that the switch is moved to a lower position. The assembled weight switch unit 15 is installed in a recess provided for it between the upper housing and the bottom housing 61. As installed, the upper switch housing portion 71 will be raised above the top housing 11 one-eighth of an inch when the switch is in the downward position.

Figure 8:
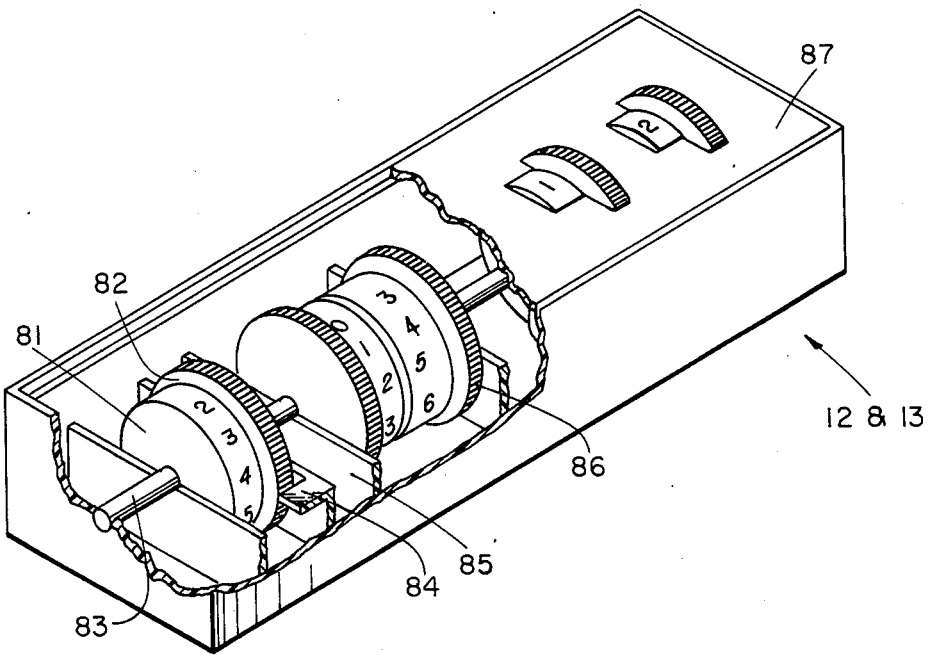
FIG. 8 is a perspective view of a numeric index or register device, forming one of the components of the apparatus of the present invention.

Referring now to FIG. 8, the numeric indexes 12 and 13 will be described in greater detail. Each index may include a small circular flat plastic disc 81 thick enough to allow the printing of the described numeric values around the perimeter for legibility. Attached to each disc 81 is a slightly larger diameter disc 82 which has its perimeter scored as at 86 to provide easy readjustment of the values by a player's finger, even when wet. The numeric indexes 81 and attached adjustment control discs 82 are placed on a dowel that acts as axle and then assembled into the respective index units 12 and 13. Each unit has provided spacing separators 85 and tension stops 84 which allow the indexes 81 to move individually but do not allow inadvertent movement through vibration or accidental contact by the players. Each assembly 12 and 13 includes a labeled cover 87 which has the required number of holes to allow free adjustment of the indices and the reading of their values. Each of the index assemblies 12 and 13 are carried by the housing 11, 61 in a manner that allows them to be recessed from the top of upper housing 11 far enough to provide a degree of protection.

Thus, the present invention provides apparatus for controlling and simulating certain aspects of the game of football. With the apparatus of the present invention the game can be played, controlled and scored without the need of additional personnel such as referees, timekeepers and scorekeepers, etc. While the apparatus utilizes a fairly complicated state-of-the-art micro-processor unit, its assembly and construction is fairly simple and compact. Its compactness allows the apparatus to be extremely portable so that it may be placed on the playing field to generally represent the ball position at the line of scrimmage.

A single embodiment of the invention has been described herein. However, variations of the embodiment are apparent and may be made without departing from the spirit of the invention. For example, instead of being activated by the weight switch 15, the apparatus might be activated by a photoelectric switch or any other suitable switch. The numeric indexes 12,13 might be electronic instead of mechanical. The number of other variations possible are many. Accordingly, it is intended that the scope of the invention be limited only by the claims which follow.

What is claimed is:

1. Apparatus for controlling and simulating certain aspects of the game of football comprising:

a housing for portably housing components of said football apparatus and for placement at any point on a football field to generally represent the ball position on the line of scrimmage and on which a football may be placed;

micro-processor unit carried by said housing for processing signals representative of designated time elements of said football game;

power means carried by said housing and connected to said micro-processor unit for supplying operating power thereto; and switch means carried by said housing and connected to said micro-processor unit for initiating specific functions thereof in response to said football being removed from said housing and in response to said football being placed thereon.

2. Apparatus for controlling and simulating the game of football as set forth in claim 1 in which said micro-processor unit includes time components for measuring one or more of the following time elements: delay time, huddle time, time out and game time.

3. Apparatus for controlling and simulating the game of football as set forth in claim 2 in which said micro-processor time components include adjustment means by which the amount of time of said time elements may be varied between specific limits.

4. Apparatus for controlling and simulating the game of football as set forth in claim 3 in which said adjustment means allows said time elements to be varied to correspond with time rules of at least one of the following sets of rules: National Football League, Canadian Football League and National Collegiate Athletic Association.

5. Apparatus for controlling and simulating the game of football as set forth in claim 3 in which said adjustment means allows said time elements to be randomly varied.

6. Apparatus for controlling and simulating the game of football as set forth in claim 2 in which said switch means is connected to one or more of said time components for initiating the functions thereof in response to movement of said football.

7. Apparatus for controlling and simulating the game of football as set forth in claim 2 including audible alarm means connected to one or more of said time components for signaling the lapse of the specific time element measured thereby.

8. Apparatus for controlling and simulating the game of football as set forth in claim 2 including register means carried by said housing for indicating one or more of the following criteria of said game: time outs, score, down, yards to go for first down, passes completed and quarter of play.

9. Apparatus for controlling and simulating the game of football as set forth in claim 2 in which one of said time elements is a game quarter clock.

10. Apparatus for controlling and simulating the game of football as set forth in claim 9 in which said game quarter clock is provided with sound detection means by which said clock may be remotely started and stopped by the sound of a whistle.

11. Apparatus for controlling and simulating the game of football as set forth in claim 1 in which said housing is adapted to provide the function of a kicking tee.

12. Apparatus for controlling and simulating the game of football as set forth in claim 1 in which said housing is adapted to safely provide, on the field, a hiking base, a kicking base and a scrimmage marker.

* * * * *